US005764259A

United States Patent [19]

Nakajima

[11] Patent Number: 5,764,259

[45] Date of Patent: Jun. 9, 1998

[54] INK FEEDING CONTAINER

[75] Inventor: Kazuhiro Nakajima, Yokohama, Japan

[73] Assignee: Canon Kabushiki Kaisha, Tokyo, Japan

[21] Appl. No.: 647,729

[22] Filed: May 15, 1996

[30] Foreign Application Priority Data

May 19, 1995 [JP] Japan ..... 7-121502

[51] Int. Cl.[6] ..... B41J 2/175

[52] U.S. Cl. ..... 347/86

[58] Field of Search ..... 347/84–87

[56] References Cited

U.S. PATENT DOCUMENTS 5,168,285 12/1992 Winslow ..... 347/87

5,504,511 4/1996 Nakajima et al. ..... 347/86

FOREIGN PATENT DOCUMENTS 2 063 175 6/1981 United Kingdom ..... 347/86

*Primary Examiner*—Benjamin R. Fuller

*Assistant Examiner*—Judy Nguyen

*Attorney, Agent, or Firm*—Fitzpatrick, Cella, Harper & Scinto

[57] ABSTRACT

An inexpensive ink feeding container which enables to adequately generate negative pressure and maintain it without any necessity for using a porous absorbing material, a spring or the like, and moreover, can adapt to an environment. The ink supply container includes an ink supply passage extending to a recording head section, a volume variable negative pressure regulating chamber which is disposed on the bottom of a box-like casing, is communicated with atmosphere and makes it possible to regulate a negative pressure corresponding to the feeding of ink, and an atmosphere communication hole disposed outside of the negative pressure regulating chamber and in the vicinity of the bottom.

22 Claims, 8 Drawing Sheets

INK FEEDING CONTAINER

BACKGROUND OF THE INVENTION

1. Field of the Invention

The present invention relates generally to an ink feeding container. More particularly, the present invention relates to an ink container which holds ink to be fed to a recording head of an ink jet recording apparatus at a suitable negative pressure.

2. Description of the Related Art

In recent years, an ink jet recording system is mainly employed in the field of a recording apparatus (printer). Since the ink jet recording system has a small-sized recording mechanism, makes it possible to fabricate the recording apparatus at a low cost, and moreover, makes it easy to print with plural colors, it is utilized for other apparatus rather than the printer, e.g., a copying machine, a facsimile machine and so forth.

To assure that a printer is operated with plural colors, recording heads for at least four kinds of colors, i.e., yellow, magenta, cyan and black colors should be prepared. Further, with respect to a serial type of printer for performing recording operations with a carriage reciprocably displaced, it is required that a carriage having a recording head mounted thereon is fabricated to be small and light in weight. Conventionally, an ink container for an ink jet printer is disposed at the lower part of the printer independently of the carriage, and ink is fed to a recording head on the carriage via a feeding passages such as a tube or the like. With this system, since merely a recording head and a small number of components are mounted on the carriage, the carriage can be fabricated with a small size and light weight. However, with this system, since a tube or the like each serving as an ink feeding passage drags by a long distance due to displacement of the carriage, gas bubbles are liable to enter in the long passage, and there is a fear that recording is incorrectly performed. This leads to a necessity that ink is sucked from the recording head side to remove bubble from the ink. At this time, a quantity of ink to be sucked should be more than the volume of the whole feeding passage. Consequently, a considerably large quantity of ink is uselessly consumed.

In view of the foregoing fact, lately, a printer of the type that an ink container is mounted on the carriage together with a recording head while the feeding passage from the ink container to the recording head is shortened has been increased. This type of recording head has features that no ink is uselessly consumed, the ink container is easily replaced with another one, and the ink container itself can easily be visualized.

In the case that the ink container is mounted on the carriage in that way, it is required that the ink container has a function of generating and maintaining adequate negative pressure. While the pressure of ink conducted to ejecting openings of the recording head is higher (positive) than the atmospheric pressure, since ink leakage from the ink ejecting openings occurs, it is necessary that the ink pressure is slightly lower (negative pressure) than the atmospheric pressure. In the conventional type that the ink container is mounted in the printer, adequate negative pressure is obtained by placing the ink container at least lower than the ejecting openings so that the required fluid pressure difference is provided by gravity. However, in the type that the ink container is mounted on the carriage, it is often impossible from the viewpoint of design that the ink container is placed at the position lower than the ink ejecting openings. For this reason, the negative pressure should be generated by means other than the gravity weight of the ink.

For example, as shown in FIG. 5, an ink container which is constructed such that a porous absorbing member 24 is filled in a container 20 and ink is impregnated in the porous absorbing member 24 is put in practical use as means for generating the foregoing type of negative pressure. This ink container is intended to generate the negative pressure by a capillary force of the porous absorbing member 24. However, when this type of ink container is excessively filled with ink to some extent, no capillary force does not appear. Accordingly, the ink container can not be filled with a large quantity of ink. Another problem is that when the ink is used, all the impregnated ink can not be used. In other words, it is necessary that the ink container 20 has a larger volume relative to a quantity of usable ink, causing a volumetric efficiency to be degraded. In addition, when ink having pigment dispersed therein is absorbed in the porous absorbing member 24, there appears a problem that the ink is denatured due to the adsorptive function. In FIG. 5, reference numeral 22 denotes a recording head section, reference 23 denotes an ink feeding passage extending to the recording head section 22, reference numeral 21 denotes an ink ejection opening, and reference numeral 25 denotes an atmosphere communicating hole.

A type of ink container which is constructed such that ink is received in a bag without any use of a absorbing member and the bag is biased by spring means in such a direction that the bag is expanded so as to generate negative pressure is developed. FIG. 6 shows this type of ink container. With this type of ink container 30, as ink is used, the spring 32 held in the bag 31 is deformed, and as the spring 32 is deformed, the negative pressure is gradually increased. However, the ink in the bag 31 can not completely be used, and the volume efficiency of the ink container 31 is not improved. Further, the spring 32 itself is fabricated at an increased cost, and an assembling operation is performed with an increased cost. Thus, the problem is that the ink container is fabricated at a high cost.

In addition, a type of ink container as shown in FIG. 7 is put in practical use. This ink container is constructed such that a bag-like movable wall 41 is disposed at a part of an ink container 40, a movable wall 41 is biased by a spring 42 attached to the movable wall 41 in such a manner that as ink is consumed, the inner volume of the container 40 is supplemented with ink. In detail, an atmosphere communication hole 25 is formed at the bottom of the container 40 so as to introduce air therethrough, and as ink 43 is fed to a recording head 22, the inner pressure of the container 40 is reduced. At this time, since ink is held by the capillary function in the atmosphere communication hole 25, air is not immediately introduced in the container 40, and the movable wall 41 is deformed in such a direction that the volume is supplemented with ink. When the differential pressure at the atmosphere communication hole 25 becomes larger than the capillary force, air is introduced into the ink container 40 through the atmosphere communication hole 25 in the form of gas bubbles as shown in FIG. 7B so that the negative pressure in the ink container 40 is slightly reduced. By repeating the foregoing operation, the interior of the ink container 40 is held at a substantially constant negative pressure.

In the case that the ink container 40 is placed in the course of practical use at the position where the temperature is high or at the place where atmospheric pressure is low, the air kept in the ink container 40 is expanded, but the cooperative function of the movable wall 41 with the spring 42 attached to the movable wall 41 prevents the pressure in the ink container 40 from being increased in excess of the atmospheric pressure.

However, the ink container shown in FIG. 7 has a function of adapting to the temperature difference or the pressure difference, but to maintain the foregoing function sufficiently practical, the bag-like movable wall 41 should be designed to be considerably large. To this end, the spring 42 itself becomes considerably large. Thus, an assembling operation is complicatedly performed, resulting in cost increase.

SUMMARY OF THE INVENTION

The present invention has been made in consideration of the aforementioned background.

An object of the present invention is to provide an inexpensive ink feeding container which can adequately generate and maintain negative pressure, and moreover, can adapt to the environment.

In a first aspect of the present invention, there is provided an ink feeding container including a boxlike casing defining an ink receiving chamber for receiving ink to be fed to a recording head section, comprising;

an ink feeding port for feeding ink in the ink receiving chamber to the recording head section formed at a lower part of the box-like casing, a volume variable negative regulating chamber disposed on a bottom of the box-like casing so as to regulate the negative pressure in the ink receiving chamber corresponding to feeding of the ink, the negative pressure chamber being communicated with atmosphere, and an atmosphere communication hole disposed outside the negative pressure regulating chamber so as to introduce atmosphere into the ink receiving chamber.

The negative pressure regulating chamber may maintain liquid tightness for the ink received in the box-like casing by a pressure receiving plate adapted to receive a water head of the ink in the box-like casing and generate negative pressure by the self gravity thereof and an expansion/contraction wall for supporting the peripheral portion of the pressure receiving plate, the expansion/contraction wall being expandable and contractible corresponding to the negative pressure and the water head.

The ink receiving container may further comprise;

an air chamber defined separately from the ink receiving chamber, and wherein the atmosphere communication hole and an air introduction port for introducing atmospheric air into the ink receiving chamber are opened to the air chamber.

The recording head section may be integrated with the box-like casing or detachably attached to the box-like casing.

The recording head section may be designed as an ink jet recording type having a function of performing recording by ejecting ink.

The atmosphere communication hole may be dimensioned to have a diameter for introducing exterior air therethrough when a capillary force is equal to a water head of about −100 mm (that is, a pressure of about −100 mmAq).

The expansion/contraction wall may exhibit a bellows-shaped contour of which one end is attached to the bottom of the box-like casing and of which other end is attached to the pressure receiving plate, and an air introduction hole is formed on a bottom surrounded by the expansion/contraction wall.

The negative pressure regulating chamber may assume a maximum volume when the expansion/contraction wall is fully expanded as the ink in the ink receiving chamber is consumed, and dimensions of the negative pressure regulating chamber are determined such that exterior air is not introduced from the atmosphere communication hole till at that time.

The air chamber may be formed at a lower corner of the box-like casing, the atmospheric communication hole is opened to a lower part of the air chamber, and the air introduction port is opened to an upper part of the air chamber.

The atmosphere communication hole may be dimensioned to have a diameter so as to allow exterior air to be introduced therethrough when the capillary force is equal to a water head of about −100 mm.

The expansion/contraction wall may exhibit a bellows-shaped contour of which one end is fixedly attached to a bottom of the box-like casing and of which other end is fixedly attached to the pressure receiving plate, and an air introduction port is formed on a bottom surrounded by the expansion/contraction wall.

The negative pressure regulating chamber may assume a maximum volume when the expansion/contraction wall is fully expanded as the ink in the ink receiving chamber is consumed, and dimensions of the pressure regulating chamber are determined such that exterior air is not introduced through the atmospheric communication hole till at that time.

In a second aspect of the present invention, there is provided an ink jet cartridge including an ink jet head section having an ejection port and an ink tank section having an ink receiving chamber for receiving ink to be fed to the ink jet head section, the ink tank section comprising;

an ink feeding port formed on a bottom of the ink receiving chamber so as to feed ink to the ink jet head section, a volume variable negative pressure regulating chamber disposed on a bottom of the ink receiving chamber to communicate with atmosphere via an air introduction port formed on the bottom, and an atmosphere communication hole formed on the bottom of the ink receiving chamber to introduce atmospheric air into the ink receiving chamber.

The ejection port may be located lower than the bottom of the ink tank section.

The atmosphere communication hole may be dimensioned to have a diameter so as to allow atmospheric air to be introduced therethrough when the capillary force is equal to about a water head of about −100 mm.

The negative pressure regulating chamber may be defined by a pressure receiving plate having a predetermined pressure receiving area for receiving a water head of ink in the ink receiving chamber, and an expandable/contractible expansion/contraction wall of which one end is fixedly attached to the bottom of the ink tank section and of which other end is fixedly attached to the pressure receiving plate.

The negative pressure regulating chamber may assume a maximum volume when the expansion/contraction wall is fully expanded as ink is consumed, and dimensions of the negative pressure regulating chamber are determined such that exterior air is not introduced from the atmosphere communication hole till that time.

In a third aspect of the present invention, there is provided an ink jet cartridge including an ink jet head section having an ejection port and an ink tank section having an ink receiving chamber for receiving ink to be fed to the ink jet head section, the ink tank section comprising;

an ink feeding port formed at a bottom of the ink receiving chamber so as to feed ink to the ink jet head section, a volume variable negative pressure chamber disposed on a bottom of the ink receiving chamber and communicated with atmosphere via a first air introduction port formed on the bottom, an air chamber formed at a lower corner portion of the ink receiving chamber and communicated with atmosphere via a second air introduction port, and an atmosphere communication hole communicated with a lower part of the air chamber so as to introduce atmosphere into the ink receiving chamber.

The ejection port may be located lower than the bottom of the ink tank section.

The atmosphere communicating hole may be dimensioned to have a diameter so as to allow exterior air to be introduced when the capillary force is equal to a water head of about −100 mm.

The negative pressure regulating chamber may be defined by a pressure receiving plate having a predetermined pressure receiving area for receiving a water head of ink on the ink receiving chamber and an expansible/contractible expansion/contraction wall of which one end is fixedly attached to the bottom of the ink tank section and of which other end is fixedly attached to the pressure receiving plate.

The negative pressure chamber may assume a maximum volume when the expansion/contraction wall is fully expanded as ink in the ink receiving chamber is consumed, and dimensions of the negative pressure chamber are determined such that exterior air is not introduced from the atmosphere communication hole till that time.

According to the present invention, when ink is fed to the recording head section and ink is ejected in response to a recording signal, the negative pressure in the box-like casing is lowered, and the volume of air in the negative pressure regulating chamber is increased to compensate for the reduction of the negative pressure. Variation of the volume is induced by introducing atmospheric air through the air introduction port.

When the ink feeding container is placed under pressure reduction or temperature rise in the course of practical use, the air kept in the box-like casing is expanded and air volume in the negative pressure regulating chamber is reduced. Thus, increase of the inner pressure is prevented and the ink conducted to the recording head is maintained in the negative pressure state.

DESCRIPTION OF THE PREFERRED EMBODIMENTS

The present invention will be described in detail hereinafter with reference to the accompanying drawings which illustrate preferred embodiments thereof.

(First Embodiment)

Figure 1:
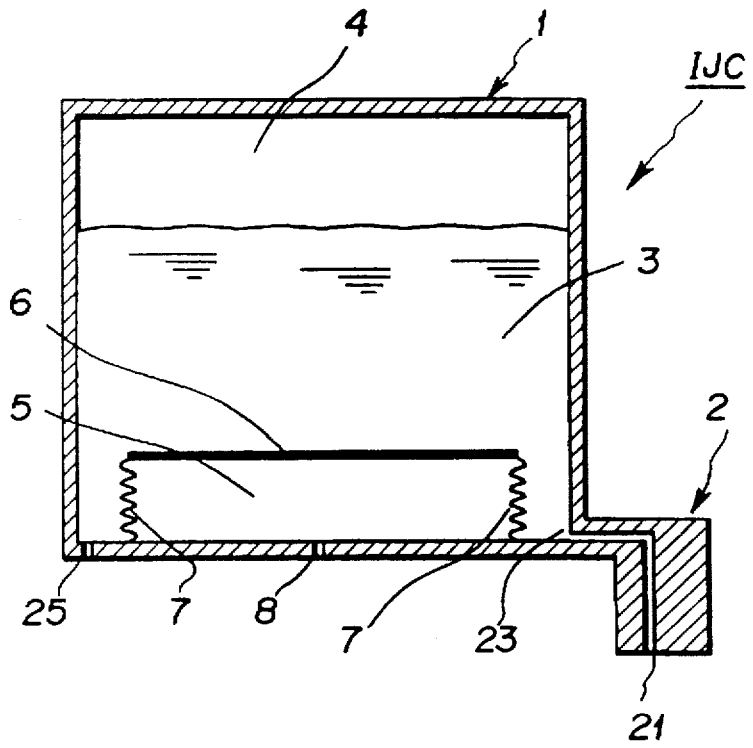
FIG. 1 is a sectional view of an ink feeding container constructed according to a first embodiment of the present invention.

FIG. 1 is a sectional view which shows by way of example the structure of an ink feeding container. Description will be made below with respect to an application example wherein a recording head section 2 having an ink ejecting function and an ink feeding container (hereinafter referred to as an ink tank section) 1 having ink 3 to be fed to the recording head section 2 contained therein are integrated with each other to construct an ink jet head cartridge (IJC).

In FIG. 1, reference numeral 4 denotes an air layer or a negative pressure layer which is kept at the upper part of the ink tank section 1, reference numeral 5 denotes a hollow space disposed to maintain the negative pressure in the ink 3 (hereinafter referred to as a negative pressure regulating chamber), reference numeral 6 denotes a pressure receiving plate for regulating the negative pressure of the ink 3 as will be described later while forming a ceiling plate of the negative pressure regulating chamber 5, reference numeral 7 denotes a bellows type expanding/contracting wall for displaceably supporting the pressure receiving plate 6 while keeping the negative pressure regulating chamber 5 gastightly, and reference numeral 8 denotes an air introduction port through which the negative pressure regulating chamber is communicated with an atmosphere.

In this embodiment, the ink tank section 1 is dimensioned to have a height of 50 mm, and an ink ejecting opening 21 of the recording head section 2 is located at the position lower than the bottom surface of the ink tank section 1 at a distance of 10 mm. The pressure receiving area where the pressure receiving plate 6 comes in contact with the ink 3 is set to about 4 $cm^2$. To assure that the ink ejection function is normally maintained in the recording head section 2, it is desirable that the ink pressure at the ink ejecting opening or port 21 is held at the negative pressure lower than the atmospheric pressure by a water head of about −30 to −150 mm. When the pressure is held excessively lower than the foregoing level, refill of the ink to the ink passage after completion of ink ejection is delayed. Consequently, there arise problems that a frequency of making it possible to eject ink is lowered, and moreover, ink can not be ejected from the ink ejecting port 21.

To assure that the negative pressure of the ink at the ink ejecting port 21 of the recording head section 2 is normally maintained between a water head of −50 to −150 mm from the beginning till the completion of use of the ink jet head cartridge, the weight of the pressure receiving plate 6 is set to about 32 g and the size of the atmosphere communication hole 25 is set to a diameter so as to allow the outdoor pressure to be taken in at a water head of about −100 mm represented by the capillary force from the viewpoint of designing of the ink feeding container (ink tank portion) 1 on the assumption that resistance at the deformation of the expansion/contraction wall 7 can sufficiently be neglected. As a result, the negative pressure of the ink ejection port 21 when the recording head portion 2 starts to be used can be maintained at a water head of 70 mm. As the ink is increasingly consumed, the negative pressure level is gradually lowered, and when the expansion/contraction wall 7 is fully expanded due to the reduction of the fluid pressure, the negative pressure at the ink ejection port 21 becomes a water head of −50 mm. When the ink 3 is continuously used, the negative pressure at the ink ejection port 21 is intensified again, and when the negative pressure reaches a water head of −90 mm, air starts to be introduced through the atmosphere communication hole 25. Thereafter, until the ink 3 is completely used, the negative pressure represented by a water head of about −90 mm can be maintained as it is.

Next, while the ink tank section 1 is held at the environmental temperature of 15°, the air layer 4 in the ink tank section 1 is lowered to about a half of the tank height by consuming ink by recording operations, and then the ink consumption is stopped and the peripheral temperature is raised up 45°. In this case, if the pressure in the air layer 4 is kept constant, the volume of the air layer 4 must be expanded by about 10%. In practice, the pressure receiving plate 6 is lowered by about 5 mm but the negative pressure level at the ejection port 21 is kept substantially unchanged.

The operative state of the ink tank section 1 in the course of ink consumption will be explained with reference to FIG. 2.

Figure 2A:
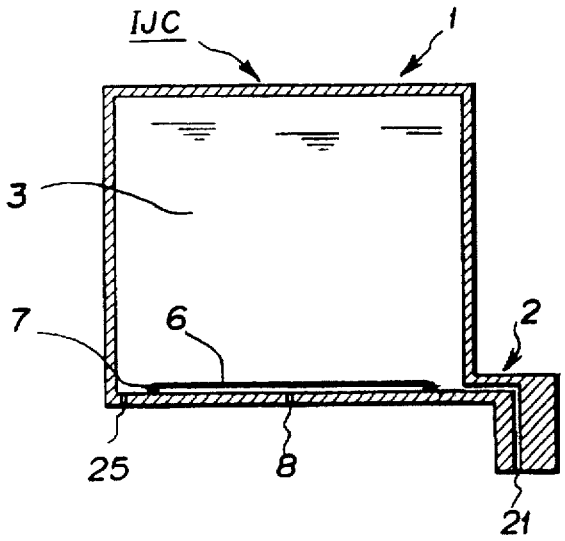
FIG. 2A to FIG. 2D are sectional views of the ink feeding container showing four steps of operation of the ink feeding container, respectively.
Figure 2B:
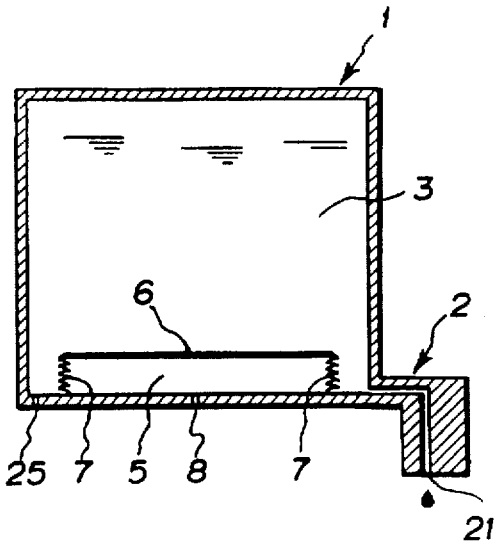
Figure 2C:
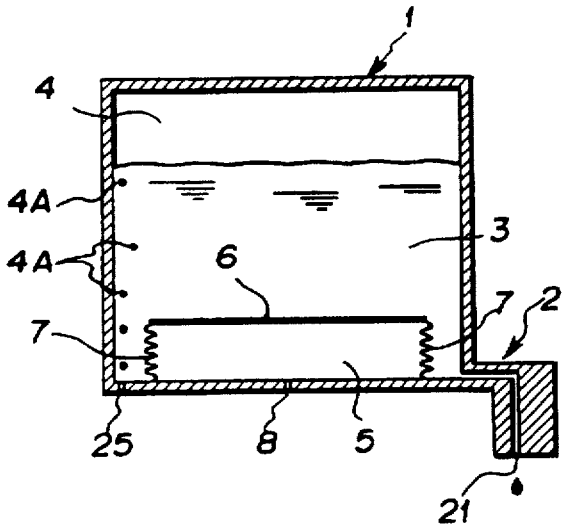

In the initial state of operation, the ink tank section 1 is held at the state that the expansion/contraction wall 7 is fully contracted and the pressure receiving plate 6 is held at the lowest position as shown in FIG. 2A so that the ink tank section 1 is fully filled with the ink 3. When recording is performed by the recording head section 2 from the foregoing state or the ink 3 is sucked from the ink ejection port 21 for a recovery operation for making it possible to perform recording, the expansion/contraction wall 7 is expanded, and as the ink 3 is increasingly used, the pressure receiving plate 6 is raised up as shown in FIG. 2B. When the ink 3 is consumed further, the expansion/contraction wall 7 is expanded to the highest state as shown in FIG. 2C, causing the pressure receiving plate 6 to be raised up from the level as shown in FIG. 2B. When the ink 3 is continuously consumed further, the pressure in the ink tank portion 1 exceeds the capillary force arising at the atmospheric communication hole 25, causing air to be introduced into the ink tank section 1 in the form of air babbles 4A as shown in FIG. 2C. This state continues until the ink 3 in the ink tank 1 is completely consumed. Thus, the pressure in the ink tank section 1 can be held at the negative pressure within a predetermined range by the capillary force at the atmosphere communication hole 25.

Figure 2D:
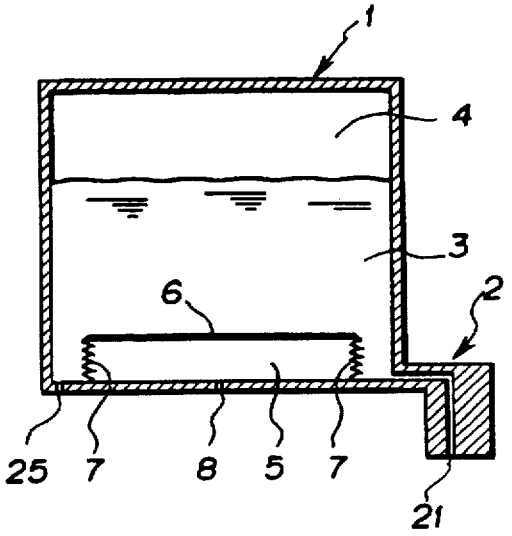

When feeding of the ink from the ink tank portion 1 is interrupted, and the whole cartridge (IJC) is exposed to a high temperature or exposed to a low pressure state, the air layer 4 kept in the ink tank section 1 is apt to be expanded. At this time, as shown in FIG. 2D, the level of the ink 3 is lowered but the expansion/contraction 7 is contracted and the pressure receiving plate 6 is lowered by a quantity of expansion of the air layer 4 while preventing the ink 3 from being leaked from the atmospheric pressure communication hole 25. It is sufficient that the volume of the negative pressure chamber 5 varying by expansion/contraction of the expansion/contraction wall 7 is determined in consideration of the temperature having a possibility of exposition and the width of pressure variation from the viewpoint of designing of the ink tank section 1.

(Second Embodiment)

Figure 3:
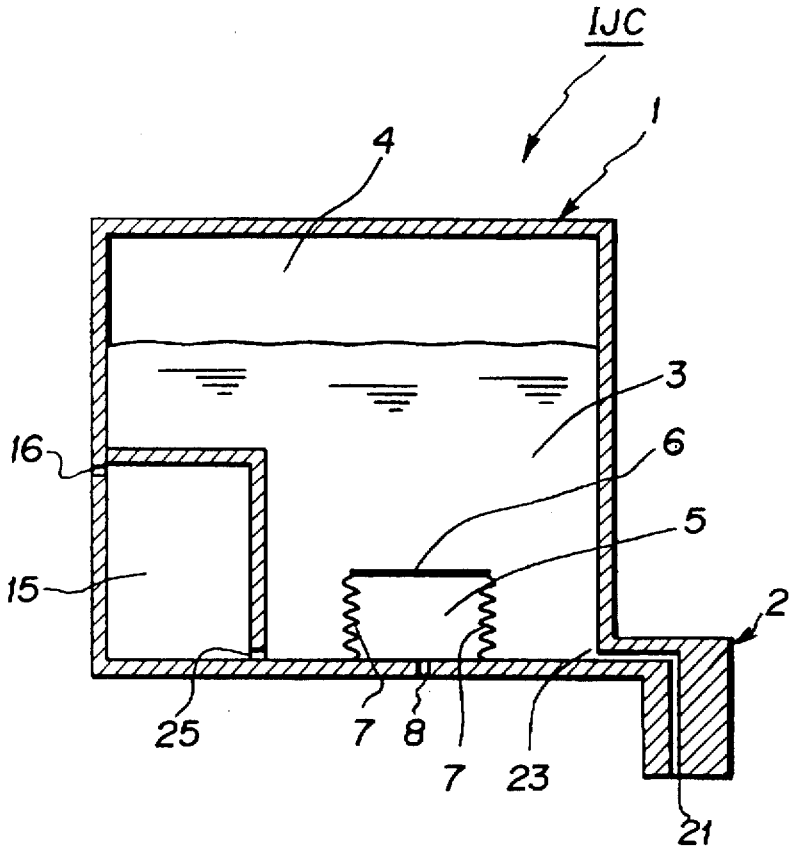
FIG. 3 is a sectional view of an ink feeding container constructed according to another embodiment of the present invention.

Another embodiment of the present invention is shown in FIG. 3. In contrast with the aforementioned first embodiment, in accordance with the second embodiment, an air chamber (buffer chamber) 15 is disposed in the ink tank section 1 and an atmosphere communication hole 25 is opened to the buffer chamber 15. In addition, an air introduction hole 16 is disposed on the side wall of the buffer chamber 15. This embodiment is different from the first embodiment in such a manner that a size of the negative regulating chamber 5 formed by the expansion/contraction wall 7 and the pressure receiving plate 6 is smaller than that in the first embodiment, the whole size of the ink tank section 1 is same to that in the first embodiment but an area of the pressure receiving plate 6 is small, i.e., about 1.5 $cm^2$. In the second embodiment, the pressure receiving plate 6 of the ink tank section 1 has a weight of 12 g which assures that a necessary negative pressure can be generated. Namely, in accordance with the second embodiment, the pressure receiving plate 6 can be designed to be small, and it is possible to reduce the whole weight of the ink tank section 1.

Operations of the ink feeding container constructed according to the second embodiment will be explained with reference to FIG. 4.

Figure 4A:
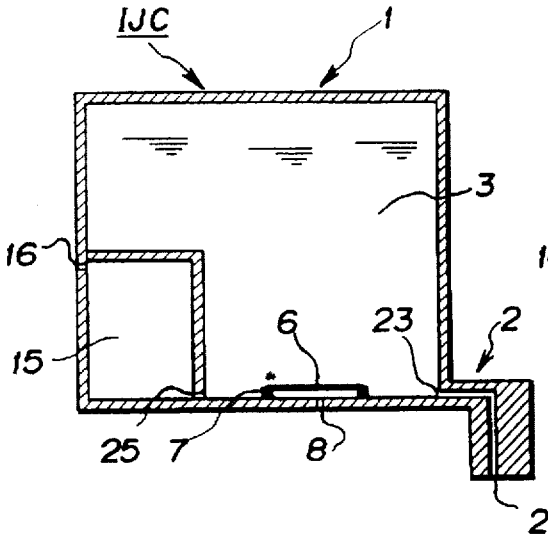
FIG. 4A to FIG. 4D are sectional views of the ink feeding container in FIG. 3 showing four steps of operation of the ink feeding container, respectively.
Figure 4B:
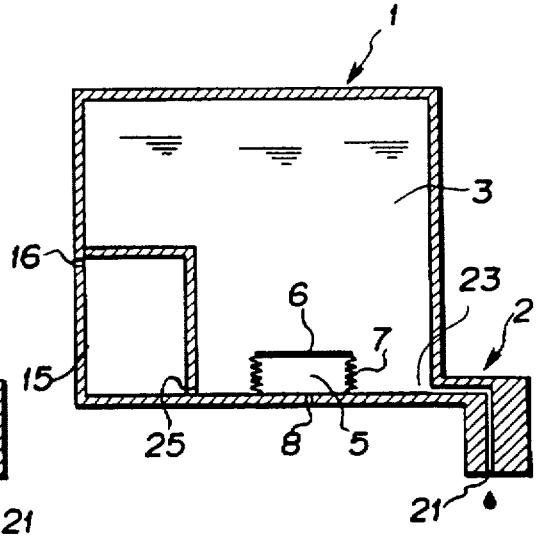
Figure 4C:
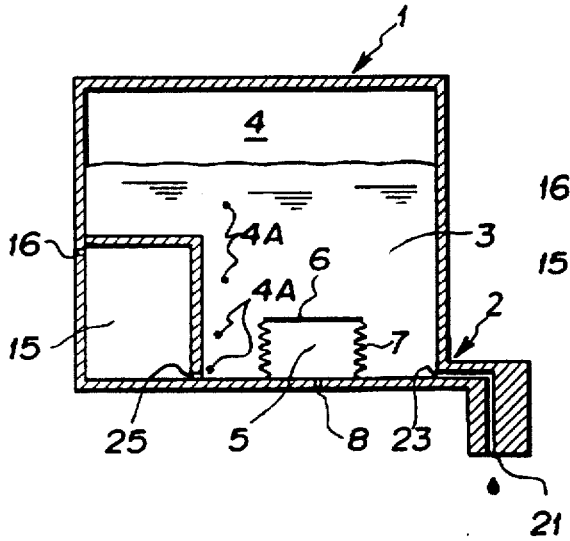

The initial state of the ink tank section 1 is such that the expansion/contraction wall 7 is fully contracted and the pressure receiving plate 6 is located at the lowest position as shown in FIG. 4A. At this time, the ink tank section 1 is fully filled with the ink 3 and air is held in the buffer chamber 15. When recording is performed by the recording head 2 or the ink 3 is sucked from the ink ejection port 21 as a recovery operation for making possible to perform recording while the foregoing state is maintained, the expansion/contraction plate 7 is expanded and the pressure receiving plate 6 is raised up as the ink 3 is consumed, as shown in FIG. 4B. When the ink 3 is further continuously consumed, the expansion/contraction wall 7 is fully expanded so that the pressure receiving plate 6 is raised up to the highest position, as shown in FIG. 4C. And, when the ink 3 is further consumed, the negative pressure in the ink tank section 1 exceeds the capillary force at the atmosphere communication hole 25 so that air is introduced into the ink tank section 1 in the form of gas bubbles 4A as shown in FIG. 4C. While the foregoing state is maintained, the pressure in the ink tank section 1 can be held as a negative pressure by the capillary force in the atmosphere communication hole 25 within a predetermined range until the ink 3 in the ink tank section 1 is fully consumed.

Figure 4D:
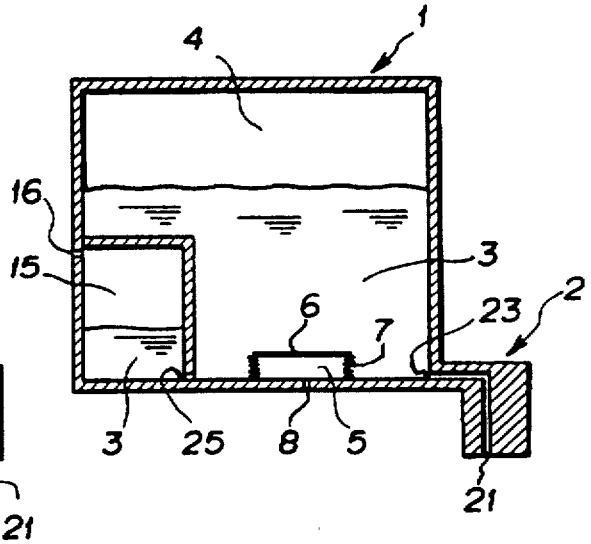
Figure 5:
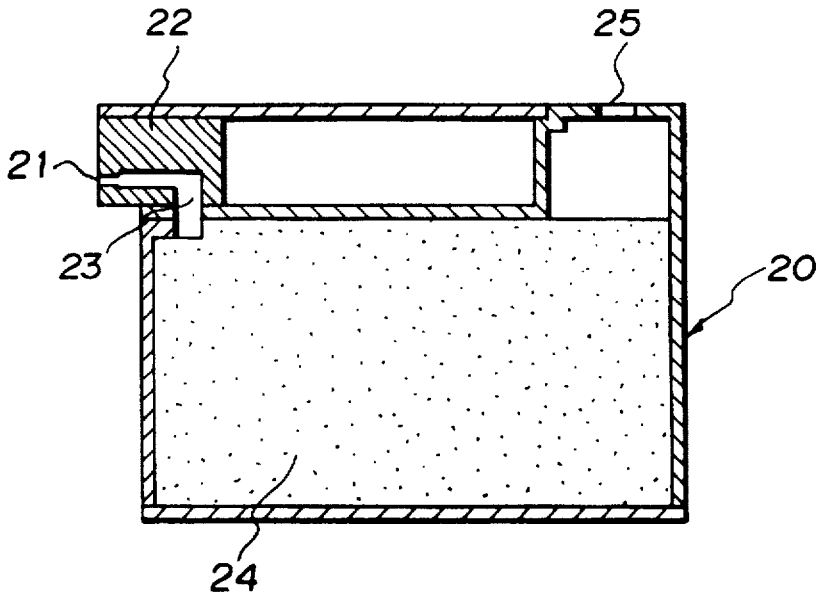
FIG.5 (PRIOR ART)
FIG. 5 is a sectional view of a conventional ink feeding container.
Figure 6:
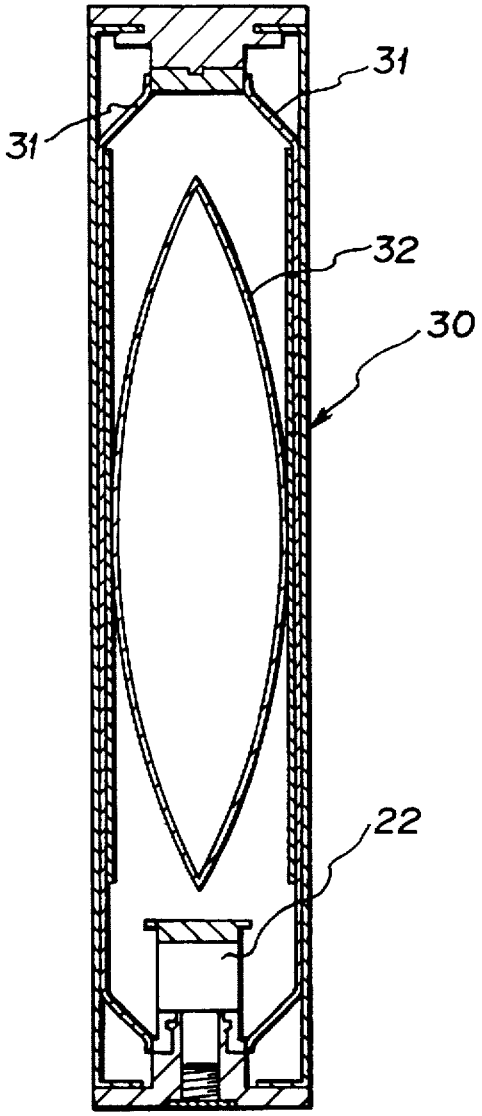
FIG.6 (PRIOR ART)
FIG. 6 is a sectional view of other conventional ink feeding container.
Figure 7A:
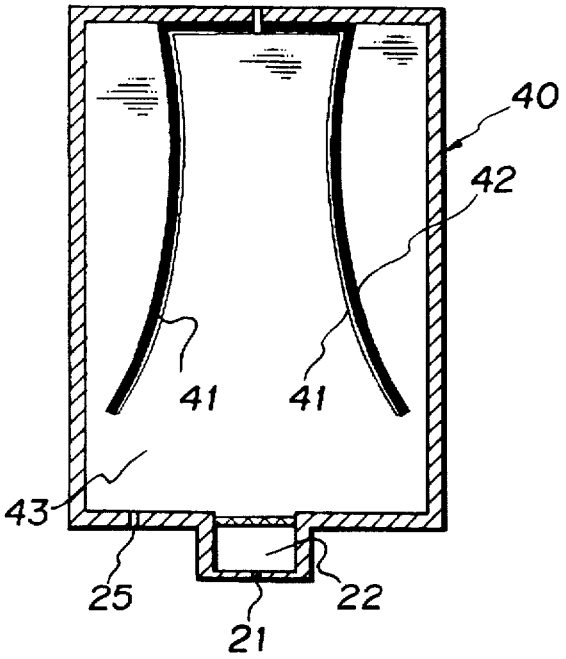
FIG.7A (PRIOR ART)
FIG. 7A and FIG. 7B are sectional views of another conventional ink feeding container showing two steps operations of the container.
Figure 7B:
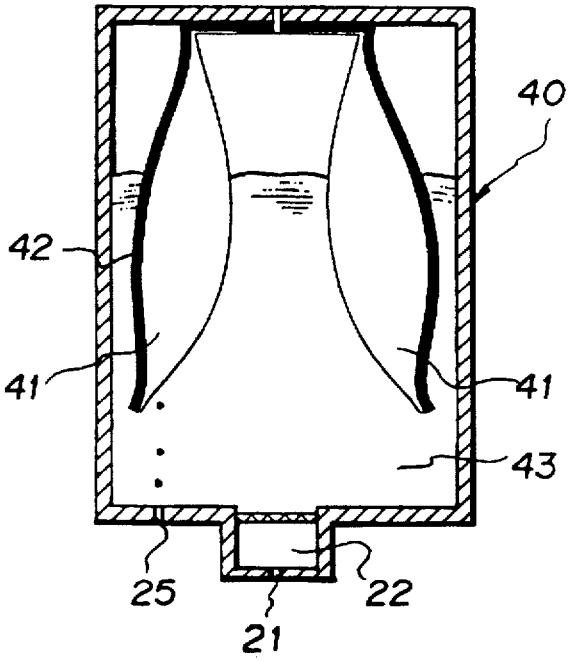
FIG.7B (PRIOR ART)

When feeding of the ink from the ink tank section 1 is interrupted at the intermediate time, and while the foregoing state is maintained, the whole cartridge (IJC) is exposed to a high temperature or to a lower pressure state, the air layer 4 kept in the ink tank section 1 is apt to expand. At this time, the level of the ink 3 is lowered as shown in FIG. 4D and the expansion/contraction wall 7 is contracted and the pressure receiving plate 6 is lowered corresponding to the expansion of the air layer 4. This prevents the ink 3 from leaking to the outside from the buffer chamber 15 via the air introduction port 16.

In contrast with the first embodiment, since the negative pressure regulating chamber 5 has a small volume, when the temperature or the pressure varies largely, the expansion of the air can not be absorbed merely by contraction of the expansion/contraction wall 7, and as shown in FIG. 4D, the ink overflows in the buffer chamber 15 via the atmosphere communication hole 25. However, when the feeding of the ink to the recording head 2 starts, the ink in the buffer chamber 15 is quickly consumed. Consequently, the normal operational state, i.e., the state as shown in FIG. 4C is restored.

It is sufficient that the volume of the buffer chamber 15 is determined in consideration of the temperature and the width of variation of the pressure having a possibility of being exposed to from the viewpoint of designing of the ink tank section 1, in addition to the volume of the negative pressure chamber 5 obtainable by expansion/contraction of the expansion/contraction wall 7.

The aforementioned embodiment shows merely one example of the practical execution of the present invention, and the manner of execution of the present invention should not be limited to these embodiments.

Figure 8A:
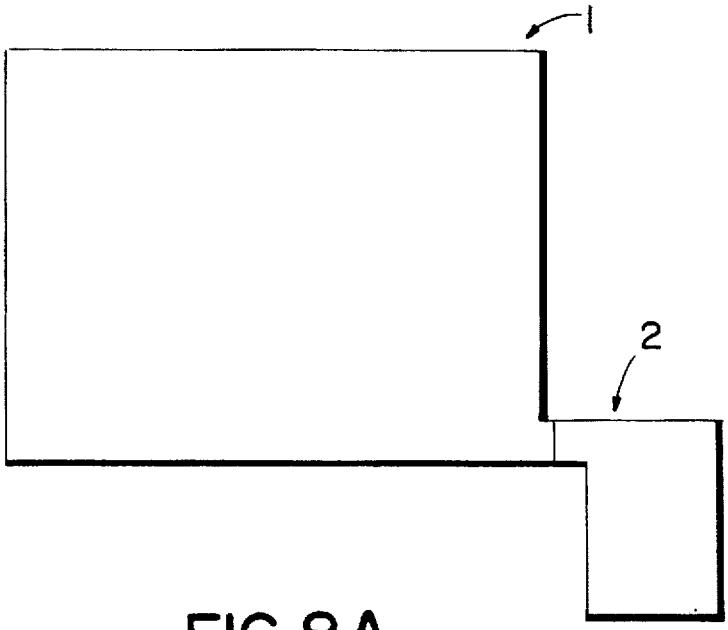
FIGS. 8A and 8B are schematic representations of a detachable recording head section respectively attached to and separated from an ink feeding container according to the present invention.
Figure 8B:
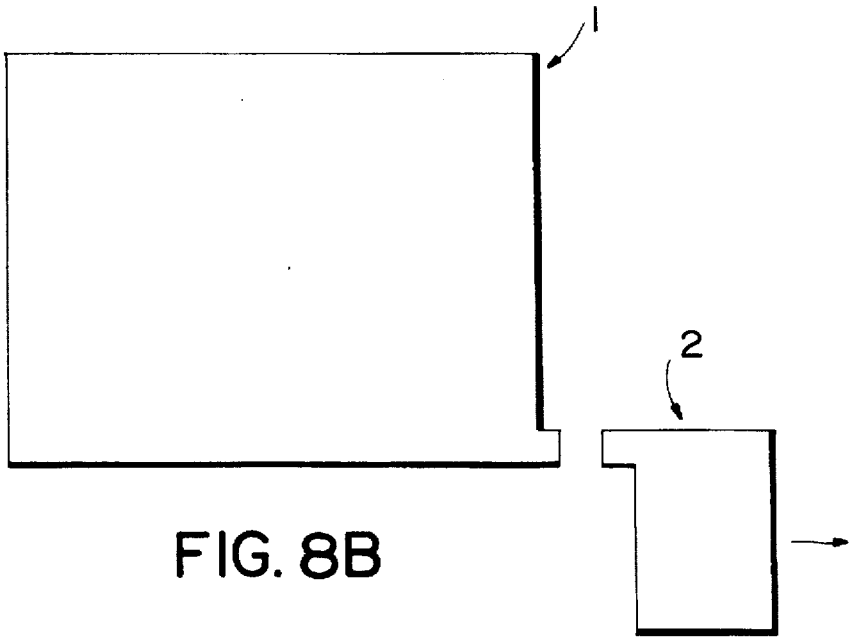

In the aforementioned embodiments, the example wherein the ink tank section is integrated with the recording head section to provide an ink jet cartridge (IJC) is shown but the present invention is equally applicable to the structure that the ink tank section 1 can be separated from the recording head section 2, as shown schematically in FIGS. 8A and 8B. In this case, hitherto a known connector or connecting means is employed for the connecting portion. However, the presence or absence of the connecting means has no effect on the structure of the present invention.

In addition, the expansion/contraction wall is constructed by a bellows molded of film-like material in the aforementioned embodiment. However, it of course is obvious that any material is employable for the bellows, provided that it can freely be expanded or contracted without substantial resistance while liquid tightness is maintained.

While the present invention has been described above with respect to two preferred embodiments, it should not be limited only to these embodiments but various change or modification may be made without departure from the scope of the present invention as defined by the appended claims.

What is claimed is:

1. An ink feeding container including a box-like casing having an interior bottom part, an upper part and a lower part and defining an ink receiving chamber for receiving ink, said casing having a recording head section formed at said lower part thereof, said container comprising:

an ink feeding port connected between said ink receiving chamber and said recording head section for feeding said ink from said ink receiving chamber to said recording head section;

a volume variable negative pressure regulator having a chamber disposed on said interior bottom part of said box-like casing to regulate negative pressure in said ink receiving chamber corresponding to feeding of said ink, said negative pressure regulating chamber being communicated with atmosphere; and an atmosphere communication hole formed in said casing and disposed outside said negative pressure regulating chamber to introduce atmospheric air into said ink receiving chamber.

2. An ink feeding container as claimed in claim 1, wherein said negative pressure regulator comprises a pressure receiving plate and an expansion/contraction wall encompassing said negative pressure regulating chamber, said pressure receiving plate having a peripheral portion, said expansion/contraction wall supporting said peripheral portion of said pressure receiving plate, said negative pressure regulator maintaining liquid tightness of said negative pressure regulating chamber with respect to the ink received in said box-like casing, said pressure receiving plate which receives a fluid pressure of the ink in said box-like casing generating the negative pressure by a self gravity thereof, and said expansion/contraction wall being expandable and contractible corresponding to said negative pressure and said fluid pressure.

3. An ink feeding container as claimed in claim 2, wherein a portion of the interior bottom part of said casing is surrounded by said expansion/contraction wall, said expansion/contraction wall exhibits a bellows-shaped contour having a top end and a bottom end, the bottom end being attached to the interior bottom part of said box-like casing and the top end being attached to said pressure receiving plate, and an air introduction hole is formed in said casing at said portion of the interior bottom part surrounded by said expansion/contraction wall.

4. An ink feeding container as claimed in claim 3, wherein said negative pressure regulator expands to provide said negative pressure regulating chamber with a maximum volume in accordance with expansion of said expansion/contraction wall as the ink in the ink receiving chamber is consumed, and said negative pressure regulating chamber comprises means for preventing introduction of exterior air through said atmosphere communication hole until said negative pressure regulating chamber assumes said maximum volume.

5. An ink feeding container as claimed in claim 1, wherein said recording head section is integrated with said box-like casing or detachably attached to said box-like casing.

6. An ink feeding container as claimed in claim 1, wherein said recording head section is an ink jet recording head which performs recording by ejecting ink.

7. An ink feeding container as claimed in claim 1, wherein said atmosphere communication hole comprises means for allowing introduction of exterior air therethrough when a capillary force is equal to a pressure of about −100 mmAq.

8. An ink feeding container having an interior and including a box-like casing having an interior bottom part, an upper part and a lower part and defining an ink receiving chamber for receiving ink, said casing having a recording head section formed at said lower part thereof, said container comprising:

an ink feeding port connected between said ink receiving chamber and said recording head section for feeding said ink from said ink receiving chamber to said recording head section;

a volume variable negative pressure regulator having a chamber disposed on said interior bottom part of said box-like casing to regulate negative pressure in said ink receiving chamber corresponding to feeding of said ink, said negative pressure regulating chamber being communicated with atmosphere;

a partition disposed in the interior of said container and connected to said box-like casing to define an air chamber separate from said ink receiving chamber;

an air introduction port formed in said casing in direct communication with said air chamber for introducing atmospheric air into said air chamber; and an atmosphere communication hole formed in said partition and disposed outside said negative pressure regulating chamber to introduce the atmospheric air into said ink receiving chamber from said air chamber.

9. An ink feeding container as claimed in claim 8, wherein said box-like casing has a lower corner which includes a corner portion of said interior bottom part, said air chamber has an upper part and a lower part, said air chamber is formed at the lower corner of said box-like casing, said atmosphere communication hole is opened to the lower part of said air chamber, and said air introduction port is opened to the upper part of said air chamber.

10. An ink feeding container as claimed in claim 9, wherein said atmosphere communication hole comprises means for allowing introduction of exterior air therethrough when a capillary force is equal to a pressure of about −100 mmAq.

11. An ink feeding container as claimed in claim 9, wherein said negative pressure regulator comprises a pressure receiving plate having a peripheral portion, an expansion/contraction wall supporting the peripheral portion of said pressure receiving plate, said expansion/contraction wall exhibits a bellows-shaped contour having a top end and a bottom end, the bottom end being fixedly attached to said interior bottom part of said box-like casing and the top end being fixedly attached to said pressure receiving plate, a portion of said interior bottom part being surrounded by said expansion/contraction wall, and an air introduction port formed in said casing at said portion of the interior bottom part surrounded by said expansion/contraction wall.

12. An ink feeding container as claimed in claim 9, wherein said negative pressure regulator expands to provide said negative pressure regulating chamber with a maximum volume in accordance with expansion of said expansion/contraction wall as the ink in the ink receiving chamber is consumed, and said negative pressure regulating chamber comprises means for preventing introduction of exterior air through said atmosphere communication hole until said negative pressure regulating chamber assumes said maximum volume.

13. An ink jet cartridge including an ink jet head section having an ejection port and an ink tank section having a casing with an interior bottom part, said casing including an ink receiving chamber for receiving ink which is fed to said ink jet head section, said ink tank section comprising:

an ink feeding port, formed in said casing at said interior bottom part and connected between said ink receiving chamber and said ink jet head section for feeding said ink from said ink receiving chamber to said ink jet head section;

a volume variable negative pressure regulator having a chamber disposed on a portion of said interior bottom part of said casing; and an air introduction port formed in said casing at the portion of said interior bottom part of said casing on which said negative pressure regulator is disposed, so that said negative pressure regulating chamber communicates with atmosphere through said air introduction port; and an atmosphere communication hole formed in the interior bottom part of said casing to introduce atmospheric air into said ink receiving chamber.

14. An ink jet cartridge as claimed in claim 13, wherein said ink tank section has a bottom which comprises said interior bottom part, and said ejection port is located lower than said bottom of said ink tank section.

15. An ink jet cartridge as claimed in claim 13, wherein said atmosphere communication hole comprises means for allowing introduction of the atmospheric air therethrough when a capillary force is equal to a pressure of about −100 mmAq.

16. An ink jet cartridge as claimed in claim 15, wherein said negative pressure regulator comprises a pressure receiving plate and an expansion/contraction wall encompassing said negative pressure regulating chamber, said pressure receiving plate having a predetermined pressure receiving area for receiving a fluid pressure of ink in said ink receiving chamber, and said expansion/contraction wall being an expandable/contractible wall having a top end and a bottom end, the bottom end being fixedly attached to the interior bottom part of said casing and the top end being fixedly attached to said pressure receiving plate.

17. An ink jet cartridge as claimed in claim 16, wherein said negative pressure regulator expands to provide said negative pressure regulating chamber with a maximum volume in accordance with expansion of said expansion/contraction wall as the ink is consumed, and said negative pressure regulating chamber comprises means for preventing introduction of exterior air through said atmosphere communication hole until said negative pressure regulating chamber assumes said maximum volume.

18. An ink jet cartridge including an ink jet head section having an ejection port and an ink tank section having an interior and a casing with an interior bottom part, said casing having a lower corner portion which includes a corner portion of said interior bottom part, said casing including an ink receiving chamber for receiving ink which is fed to said ink jet head section, said ink tank section comprising:

an ink feeding port, formed in said casing at said interior bottom part and connected between said ink receiving chamber and said ink jet head section for feeding said ink from said ink receiving chamber to said ink jet head section;

a volume variable negative pressure regulator having a chamber disposed on a portion of said interior bottom part of said casing;

a first air introduction port, formed in said casing at the portion of said interior bottom part of said casing on which said negative pressure regulator is disposed, so that said negative pressure regulating chamber communicates with atmosphere through said first air introduction port;

a partition disposed in the interior of said ink tank section and having a lower part, said partition being connected to said casing to define an air chamber formed at the lower corner portion of said casing and having an exterior wall comprising a portion of said casing;

a second air introduction port formed in the exterior wall of said air chamber, so that said air chamber communicates with atmosphere through said second air introduction port; and an atmosphere communication hole formed in said partition at said lower part so as to introduce atmospheric air into said ink receiving chamber.

19. An ink jet cartridge as claimed in claim 18, wherein said ink tank section has a bottom which comprises said interior bottom part, and said ejection port is located lower than said bottom of said ink tank section.

20. An ink jet cartridge as claimed in claim 19, wherein said atmosphere communication hole comprises means for allowing introduction of exterior air therethrough when a capillary force is equal to a pressure of about −100 mmAq.

21. An ink jet cartridge as claimed in claim 20, wherein said negative pressure regulator comprises a pressure receiving plate and an expansion/contraction wall encompassing said negative pressure regulating chamber, said pressure receiving plate having a predetermined pressure receiving area for receiving a fluid pressure of ink in said ink receiving chamber and said expansion/contraction wall being an expandable/contractible wall having a top end and a bottom end, the bottom end being fixedly attached to the interior bottom part of said casing and the top end being fixedly attached to said pressure receiving plate.

22. An ink jet cartridge as claimed in claim 21, wherein said negative pressure regulator expands to provide said negative pressure regulating chamber with a maximum volume in accordance with expansion of said expansion/contraction wall as the ink in the ink receiving chamber is consumed, and said negative pressure regulating chamber comprises means for preventing introduction of exterior air through said atmosphere communication hole until said negative pressure regulating chamber assumes said maximum volume.

* * * * *

UNITED STATES PATENT AND TRADEMARK OFFICE

CERTIFICATE OF CORRECTION

PATENT NO. : 5,764,259

DATED : June 9, 1998

INVENTOR(S): KAZUHIRO NAKAJIMA

It is certified that error appears in the above-identified patent and that said Letters Patent is hereby corrected as shown below:

COLUMN 1

Line 14, "makes" should read --which makes--; and
Line 29, "passages" should read --passage--.

COLUMN 2

Line 10, "no" should be deleted; and
Line 26, "a" should read --an--.(2nd occurrence)

COLUMN 3

Line 22, "comprising;" should read --comprising:--; and
Line 44, "comprise;" should read --comprise:--.

COLUMN 4

Line 33, "comprising;" should read --comprising:--.

COLUMN 5

Line 1, "comprising;" should read --comprising:--; and
Line 66, "other" should read --another--.

COLUMN 7

Line 44, "babbles" should read --bubbles--.

UNITED STATES PATENT AND TRADEMARK OFFICE

CERTIFICATE OF CORRECTION

PATENT NO. : 5,764,259

DATED : June 9, 1998

INVENTOR(S): KAZUHIRO NAKAJIMA

It is certified that error appears in the above-identified patent and that said Letters Patent is hereby corrected as shown below:

COLUMN 8

Line 10, "to" should read --as--.

COLUMN 9

Line 28, "change" should read --changes--; and
Line 29, "modification" should read --modifications--.

COLUMN 11

Line 32, "casing; and" should read --casing;--.

Signed and Sealed this

Second Day of March, 1999

*Attest:*

*Attesting Officer*

Q. TODD DICKINSON

*Acting Commissioner of Patents and Trademarks*